US008406663B2

(12) United States Patent
Lim et al.

(10) Patent No.: US 8,406,663 B2
(45) Date of Patent: Mar. 26, 2013

(54) DEVELOPING ROLLER FOR ELECTROPHOTOGRAPHIC IMAGE FORMING APPARATUS, AND MANUFACTURING METHOD OF THE SAME

(75) Inventors: An-kee Lim, Yongin-si (KR); Tae-hyun Kim, Hwaseong-si (KR); Mi-na You, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 282 days.

(21) Appl. No.: 12/833,219

(22) Filed: Jul. 9, 2010

(65) Prior Publication Data

US 2011/0110690 A1 May 12, 2011

(30) Foreign Application Priority Data

Nov. 11, 2009 (KR) ..... 10-2009-0108639

(51) Int. Cl.
*G03G 15/08* (2006.01)

(52) U.S. Cl. ..... 399/286

(58) Field of Classification Search ..... 399/252, 399/265, 279, 286; 526/329.5; 528/75
See application file for complete search history.

(56) References Cited

U.S. PATENT DOCUMENTS

| | | | | |
|---|---|---|---|---|
| 5,804,114 | A | 9/1998 | Janes et al. | |
| 2009/0060597 | A1 * | 3/2009 | Yoshida et al. | 399/286 |

FOREIGN PATENT DOCUMENTS

| | | |
|---|---|---|
| JP | 09-269651 | 10/1997 |
| JP | 2008-292593 | 12/2008 |
| KR | 10-739695 | 7/2007 |

* cited by examiner

*Primary Examiner* — Hoan Tran
(74) *Attorney, Agent, or Firm* — Stanzione & Kim, LLP

(57) ABSTRACT

The disclosure provides a developing roller for an electrophotographic image forming apparatus, and a method of manufacturing the same. The developing roller includes a shaft member and a resilient member provided on the shaft member. The resilient member includes a conductive resilient layer in contact with the shaft member and a conductive resin layer defining the outer surface of the resilient member. The conductive resin layer includes a resin and a surface-treated metal oxide. The developing roller is capable of an increased amount of toner charging while stably maintaining optical density.

8 Claims, 2 Drawing Sheets

DEVELOPING ROLLER FOR ELECTROPHOTOGRAPHIC IMAGE FORMING APPARATUS, AND MANUFACTURING METHOD OF THE SAME

CROSS-REFERENCE TO RELATED APPLICATIONS

This application claims priority from Korean Patent Application No. 10-2009-0108639, which was filed in the Korean Intellectual Property Office on Nov. 11, 2009, the disclosure of which is hereby incorporated by reference in its entirety for all purposes.

BACKGROUND

1. Field of the Invention

The disclosure relates generally to a developing roller for an electrophotographic image forming apparatus, and a manufacturing method of the same, and more specifically, to a developing roller that ensures an increased toner charging amount and a uniform optical density.

2. Description of the Related Art

An electrophotographic image forming apparatus, such as a laser printer, a facsimile, or a copier, generally employs an image forming configuration in which one or more of a charging roller, a developing roller and a transfer roller are arranged around a photosensitive medium. In an electrophotographic image forming apparatus of such configuration, a developing agent such as, for example, toner, is supplied from a developing device to the photosensitive medium during the image forming operation.

By way of example, during an image forming operation, the surface of the photosensitive medium is charged by the charging roller to a uniform electrical potential, and is then exposed to light from a light exposure unit discharging selective portions of the surface to causes an electrostatic latent image as a pattern of potential difference corresponding to the desired image to be formed on the surface of the charged photosensitive medium. The developing roller supplies the developing agent to the photosensitive medium to thereby visualize or develop the electrostatic latent image into a developer image. The developer image is then transferred by the transfer roller onto a printing medium such as, for example, a sheet of paper, as the printing medium passes between the photosensitive medium and the transfer roller.

The developing roller of such electrophotographic image forming apparatus needs to have suitable transfer characteristics and resiliency so as to reliably contact the photosensitive medium, and to transfer toner onto the electrostatic latent image. Although a non-magnetic mono-component developer is widely used in the image developing art, due to the difficulty in controlling the charging of the toner, the toner being carried on the developing roller may be inconsistently or unstably charged, resulting in image defects such as, for example, ghosting. It is particularly difficult to obtain high quality images with high optical density under lower temperature and/or in low humidity environments. There thus remains a need in the art for improvement in the developing rollers for use in an electrophotographic image forming apparatus.

SUMMARY

Aspects of the present disclosure provides a developing roller capable of maintaining a constant optical density, capable of reducing the occurrences of ghosts, and/or capable of achieving high optical density even in low temperature and in low humidity environments. Aspects of the present disclosure also provides a method of manufacturing the developing roller.

According to one aspect of the disclosure, there is provided a developing roller for an electrophotographic image forming apparatus, which may include a shaft member and a resilient member provided on the shaft member. The resilient member may comprise a conductive resilient layer, in contact with the shaft member, and a conductive resin layer, which is the surface layer of the conductive resilient layer. The conductive resin layer may comprises a resin and a surface-treated metal oxide.

The metal oxide may be one or a combination of two or more metal oxides selected from titanium dioxide, silica, alumina, magnesium oxide and zinc oxide.

The metal oxide may be surface-treated with a silane compound.

The metal oxide may be surface-treated with a silane compound, which silane compound may be one or a combination of two or more silane compounds selected from vinyltrichlorosilane, vinyltrimethoxysilane, vinyltriethoxysilane, 2-(3,4 epoxycyclohexyl)ethyltrimethoxysilane, 3-glycidoxypropyltrimethoxysilane, 3-glycid-oxypropylmethyldiethoxysilane, 3-glycidoxypropyltriethoxysilane, p-styryltrimethoxysilane, 3-methacryloxypropylmethyldimethoxysilane, 3-methacryloxypropyltrimethoxysilane, 3-meth-acryloxypropylmethyldiethoxysilane, 3-methacryloxypropyltriethoxysilane, 3-acryloxypropyl-trimethoxysilane, N-(2-aminoethyl)-3-aminopropylmethyldimethoxysilane, N-2 (aminoethyl)-3-aminopropyltriethoxysilane, 3-aminopropyltrimethoxysilane, 3-aminopropyltriethoxysilane, 3-triethoxysilyl-N-(1,3 dimethyl-butylidene)propylamine, N-phenyl-3-aminopropyl-trimethoxy-silane, N-(vinylbenzyl)-2-aminoethyl-3-aminopropyltrimethoxysilane hydrochloride, 3-chloropropyltrimethoxysilane, 3-mercaptopropylmethyldimethoxysilane, 3-mercapto-propyl-trimethoxysilane, bis(triethoxysilylpropyl)tetrasulfide, tetraethoxysilane, methyltrimethoxy-silane, methyltriethoxysilane, dimethyldimethoxysilane, phenyltrimethoxysilane, hexamethyl-disilazane, hexyltrimethoxysilane, hexyltriethoxysilane, decyltrimethoxysilane and methylhydrogen siloxane.

The metal oxide may be surface-treated with a silane compound, which silane compound may be one or a combination of two or more silane compounds. The silane compound may ranges from about 1% by weight to about 40% by weight based on 100% by weight of the metal oxide.

The resin may be one or a combination of two or more resins selected from a polyamide resin, urethane resin, urea resin, imide resin, melamine resin, fluororesin, phenol resin, alkyl resin, silicone resin, polyester resin and polyether resin.

The metal oxide may range from about 5% by weight to about 150% by weight based on 100% by weight of the resin.

The conductive resin layer may further comprise a stabilizer.

The conductive resin layer may further comprise a stabilizer. The stabilizer may comprise an amine stabilizer having primary, secondary and tertiary amine structures.

According to another aspect of the disclosure, there is provided an electrophotographic image forming apparatus, including any of the developing rollers described herein.

According to another aspect of the disclosure, there is provided a method for manufacturing a developing roller for an electrophotographic image forming apparatus. Such method may comprise a) forming a conductive resilient layer on a shaft; b) surface-treating a metal oxide with a silane compound; c) preparing a coating composition for the conductive resin layer by mixing the surface-treated metal oxide and a resin in such a manner the surface-treated metal oxide is dispersed in the resin; and d) applying the coating composition for the conductive resin layer on the conductive resilient layer.

The metal oxide may be one or a combination of two or more metal oxides selected from titanium dioxide, silica, alumina, magnesium oxide and zinc oxide.

The silane compound may range from about 1% by weight to about 40% by weight based on 100% by weight of the metal oxide.

The silane compound may be one or a combination of two or more silane compounds selected from vinyltrichlorosilane, vinyltrimethoxysilane, vinyltriethoxysilane, 2-(3,4 epoxycyclohexyl)-ethyltrimethoxysilane, 3-glycidoxypropyltrimethoxysilane, 3-glycidoxypropylmethyl-diethoxysilane, 3-glycidoxypropyltriethoxysilane, p-styryltrimethoxysilane, 3-methacryl-oxypropylmethyldimethoxysilane, 3-methacryloxypropyltrimethoxysilane, 3-methacryloxy-propylmethyldiethoxysilane, 3-methacryloxypropyltriethoxysilane, 3-acryloxypropyl-trimethoxysilane, N-(2-amino-ethyl)-3-aminopropylmethyldimethoxysilane, N-2(aminoethyl)-3-aminopropyltriethoxy-silane, 3-aminopropyltrimethoxysilane, 3-aminopropyltriethoxysilane, 3-triethoxysilyl-N-(1,3 dimethyl-butylidene)propylamine, N-phenyl-3-aminopropyltrimethoxy-silane, N-(vinylbenzyl)-2-aminoethyl-3-aminopropyltrimethoxysilane hydrochloride, 3-chloro-propyltrimethoxysilane, 3-mercaptopropylmethyldimethoxysilane, 3-mercaptopropyl-trimethoxysilane, bis(triethoxysilylpropyl)tetrasulfide, tetraethoxysilane, methyltrimethoxy-silane, methyltriethoxysilane, dimethyldimethoxysilane, phenyltrimethoxysilane, hexamethyl-disilazane, hexyltrimethoxysilane, hexyltriethoxysilane, decyltrimethoxysilane and methylhydrogen siloxane.

BRIEF DESCRIPTION OF THE DRAWINGS

Various features and advantages of the present disclosure will become more apparent by describing in detail several embodiments thereof with reference to the attached drawings, in which.

DETAILED DESCRIPTION OF THE EMBODIMENTS

Figure 1:
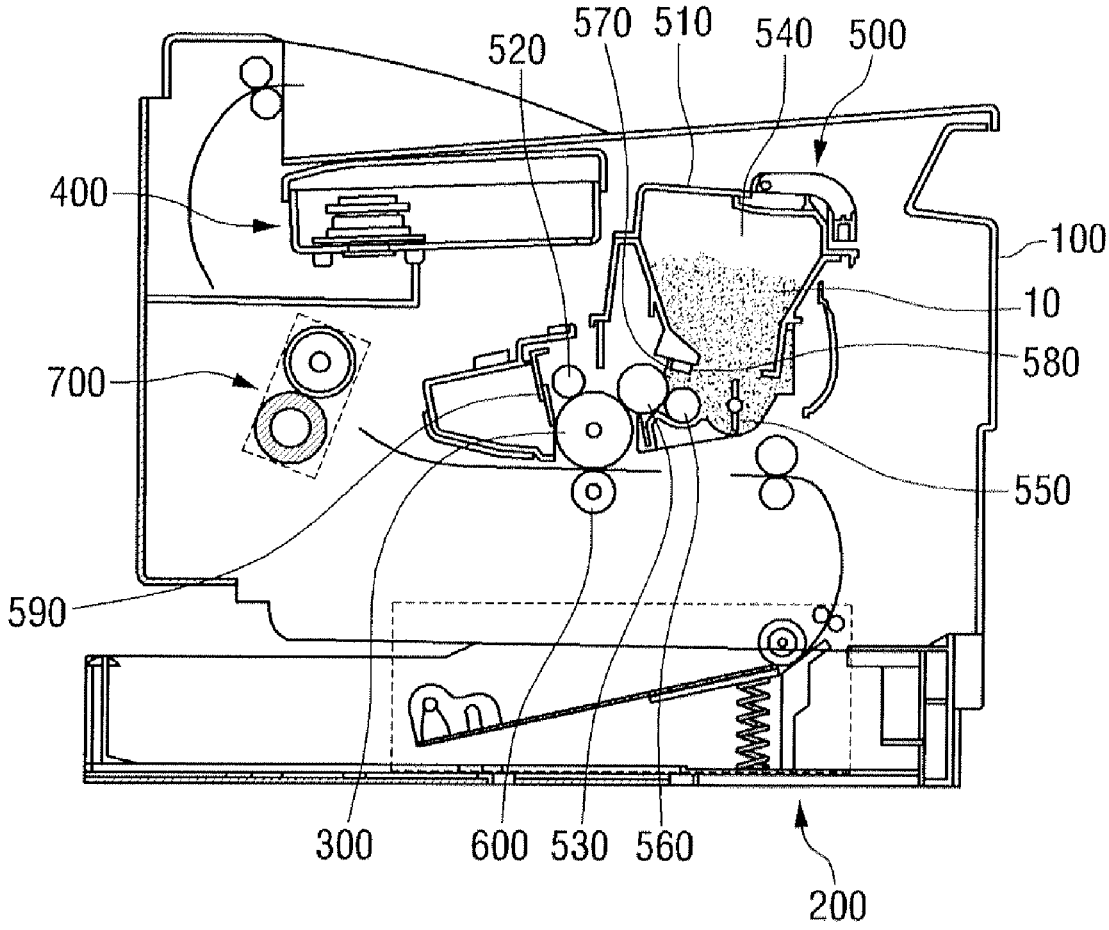
FIG. 1 is a schematic view illustrating an electrophotographic image forming apparatus having a developing roller according to an embodiment of the present disclosure.

Reference will now be made in detail to embodiments of the present invention, examples of which are illustrated in the accompanying drawings, wherein like reference numerals refer to like elements. While the embodiments are described with detailed construction and elements to assist in a comprehensive understanding of the various applications and advantages of the embodiments, it should be apparent however that the embodiments can be carried out without those specifically detailed particulars. Also, well-known functions or constructions will not be described in detail so as to avoid obscuring the description with unnecessary detail. It should be also noted that in the drawings, the dimensions of the features are not intended to be to true scale and may be exaggerated for the sake of allowing greater understanding.

FIG. 1 is a schematic view illustrating an electrophotographic image forming apparatus, in which a charging roller fabricated according to an embodiment of the present disclosure may be employed. Referring to FIG. 1, an image forming unit 500 may be provided in the main housing 100 of an electrophotographic image forming apparatus, and may include a photosensitive medium 300. According to an embodiment, the image forming unit 500 may be detachably received in the main housing 100 so as to allow servicing and/or replacement of the image forming unit 500. Alternatively, one or more components such as for example, a toner cartridge including the toner container chamber 540 defined by the sub-frame 510, may be removable separately from the remainder of the image forming unit 500.

The photoconductive surface of the photosensitive medium 300 may be charged to a predetermined electrical potential by a charging roller 520. Selective portions of the photosensitive medium 300 so charged is then exposed to light, those portions exposed to light discharging so as to form a latent image as a pattern of charge or potential differences, which pattern corresponding to the desired image to be formed. Developing agent or toner 10 is then applied from the developing roller 530 to the surface of the photosensitive medium 300 so as to develop the latent image thereon into a developer image.

The developing agent 10 may become charged or receive certain additional charges from the rubbing contact with the agitator 550, the feeding roller 560 and the toner layer regulating device 570. The agitator 550 may be configured to rotate or otherwise move inside the toner container chamber 540 so as to reduce solidification or lumping of the developing agent 10, and may be configured to cause a movement of the developing agent 10 toward the outlet 580 and toward the feeding roller 560. The feeding roller 560 may be configured to convey certain amount of the developing agent 10 to the developing roller 530. The toner layer regulating device 570 may operate to regulate the amount of developing agent 10 that is to be carried by the developing roller 530 to the photosensitive medium 300 so that a thin relatively uniform layer of developing agent 10 may be carried by the developing roller 530. The feeding roller 560 may be fabricated using a semiconductive foamed material. The developing agent 10, which is a consumable developer used for the developing processes, may have a resin as a main ingredient. The charging roller 520 may be used for charging a photosensitive medium, for which purposes it is known that a corona charging device may alternatively be used. A cleaning blade 590 may be a plate formed of urethane rubber material or the like, and may be arranged to remove the residual toner from the photosensitive medium 300 after the transfer of the developer image onto a printing medium that is supplied from the printing medium supplying unit 200.

A laser scanning unit 400 may be used to illuminate light onto the surface of the photosensitive medium 300 using a light source such as, for example, a laser diode or the like, to selectively expose portions of the surface of the photosensitive medium 300 to light, and to thus form a latent image. The transfer roller 600 may operate to transfer the developing agent such as, for example, toner, of the developer image, which is attached to the surface of the photosensitive medium 300 by the relatively weak attractive force of the surface potential differences of the latent image, onto a printing medium such as, for example, a sheet of paper, by applying an electrical potential of the opposite polarity. The printing medium onto which the developer image has been transferred may travel further to the fusing unit 700, at which the developer image is fixed onto the printing medium by the application of heat and/or pressure, thus completing the process of forming the desired image on the printing medium.

Figure 2A:
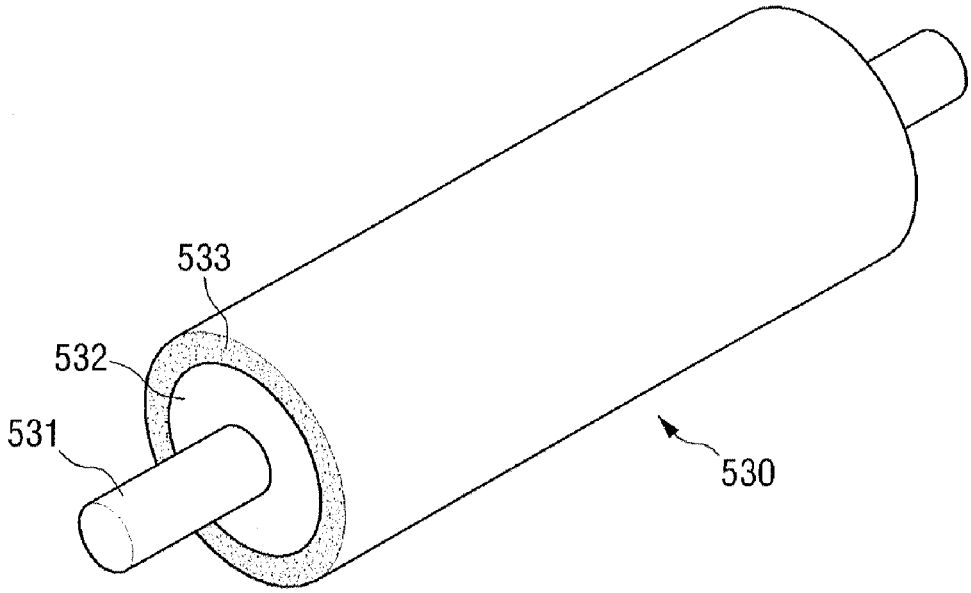
FIG. 2A is a schematic view illustrating a developing roller according to an embodiment of the present disclosure.
Figure 2B:
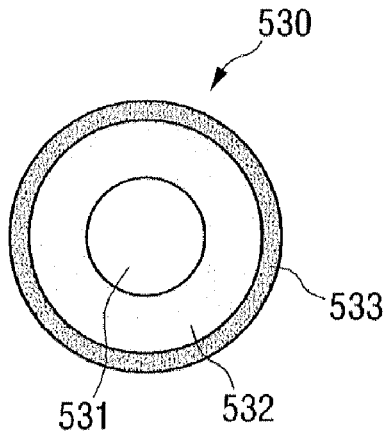
FIG. 2B is a schematic cross sectional view of the developing roller of FIG. 2A.

Referring now to FIGS. 2A and 2B, the developing roller 530 according to an embodiment may include a conductive shaft member 531, a conductive resilient layer 532 formed around the conductive shaft member 531 and a conductive resin layer 533 forming the outermost layer of the developing roller 530. According to an embodiment, the conductive resin layer 533 may include a conductive resin and a surface-treated metal oxide. According to an embodiment, the conductive resin layer 533 may additionally include a stabilizer.

Any shaft having satisfactory conductivity may be employed in the developing roller 530 as the conductive shaft member 531. The conductive shaft member 531 may be formed generally in a cylindrical shape, and may be fabricated using metals, for example, aluminum, iron or stainless steel. According to an embodiment, the conductive shaft member 531 may have an outer diameter ranging from about 4 mm to about 10 mm.

The conductive resilient layer 532 formed on the shaft may have a predetermined level of resiliency, and to that end, may be formed of a resilient material. By way of non-limiting examples, the conductive resilient layer 532 may be made from polyurethane, natural rubber, butyl rubber, nitrile rubber, polyisoprene rubber, polybutadiene rubber, silicone rubber, styrene-butadiene rubber, ethylene-propylene rubber, ethylene-propylene-diene rubber, chloroprene rubber, acryl rubber, or any combination thereof. Silicone rubber and a ethylene-propylene-diene rubber may also be used for the conductive resilient layer 532. If silicone rubber or ethylene-propylene-diene rubber is used, the developing roller 530 may have reduced hardness, and improved abrasion-resistant property. Therefore, image degradation due to deteriorated abrasion-resistant property by aging may be prevented, and toner leakage due to abrasion of the toner sealing portions on both ends of the roller may also be prevented.

Examples of silicone rubber for use in the conductive resilient layer 532 may include, but are not limited to, methyl phenyl silicone rubber, fluoro modified silicone rubber, polyether modified silicone rubber, alcohol modified silicone rubber and the like. The materials listed herein may be used individually, or two or more thereof may be used in combination.

In some embodiments the conductive resilient layer 532 may have hardness within a range from about 25 to about 70 degrees in Asker-C type measurement. If hardness is below 25 degrees, the conductive resilient layer 532 may easily be deformed by contact with the developing blade or with the photosensitive medium, possibly causing image degradation, particularly across the horizontal lines of the image. Therefore, it is desirable that the conductive resilient layer 532 has hardness of 25 degrees or above. If hardness exceeds 70 degrees, image degradation may be caused due to toner stress. Therefore, it is desirable that the conductive resilient layer 532 has less than 70 degrees of hardness.

The thickness of the conductive resilient layer 532 may range from about 1.0 mm to about 8.0 mm because good resiliency and recovery of the conductive resilient layer 532 from deformed state is ensured within this range. It is also within this range that the toner stress may be reduced.

An electroconductive material may be added to the conductive resilient layer 532 to provide conductivity. Conductive material in the conductive resilient layer 532 may have specific resistance ranging from about $10^3$ to about $10^{10}$ Ωcm as a stable range, and more preferably from about $10^4$ to about $10^8$ Ωcm. Examples of conductive agents in the conductive resilient layer 532 may include, but are not limited to, a conductive carbon such as Ketjen Black EC, or acetylene black, a carbon black for use in rubber such as super abrasion furnace (SAF) carbon black, intermediate super abrasion furnace (ISAF) carbon black, high abrasion furnace (HAF) carbon black, fast extruding furnace (FEF) carbon black, general purpose furnace (GPF) carbon black, semi-reinforcing furnace (SRF) carbon black, fine thermal (FT) carbon black, or medium thermal (MT) carbon black, a carbon black for coloring that is treated with oxidation or the like, a metal such as copper, silver germanium, or metal oxide of such metal, and the like. In some embodiments, a type of carbon black that can regulate conductivity easily with only with a small amount may be used. An ion conductive material may also be used as a conductive agent instead of the electro-conductive material. By way of example, an inorganic ionic conductive material such as sodium perchlorate, lithium perchlorate, calcium perchlorate, or lithium chloride, may be used, or an organic ionic conductive material such as modified aliphatic dimethylaluminum isosulfate, or stearylammonium acetate may be used. The above-listed materials may be used individually, or two or more may be used in combination.

The amount of the conductive agent added to the conductive resilient layer 532 may range from about 0.5% to about 50% by weight, relative to 100% by weight of the conductive resilient layer 532, and, more preferably, from about 1% to about 30% by weight.

The developing roller 530 may be made by forming the conductive resilient layer 532 on the shaft, and coating the conductive resin layer 533 on the surface of the conductive resilient layer 532.

The conductive resin layer 533 of the developing roller 530 may include a resin and a surface-treated metal oxide. Examples of the resin may include, but are not limited to, polyamide resin, urethane resin, urea resin, imide resin, melamine resin, fluororesin, phenol resin, alkyl resin, silicone resin, polyester resin, polyether resin and the like. The above-listed resins may be used individually, or two or more may be used in combination.

In some embodiments, urethane resin may be used for the conductive resin layer 533. The urethane resin is a polymer having urethane links that can be made using material having isocyanate components containing isocyanate groups and polyol components having hydroxyl groups. The urethane resin may be particularly excellent in rubbing against and electrically charging the toner, and may also have abrasion-resistant property and high durability.

Examples of isocyanate component may include, but are not limited to, trilene diisocyanate (TDI), 4,4'-methylene diphenyl diisocyanate (MDI), polymeric methylene diphenyl diisocyanate, modified methylene diphenyl diisocyanate, 1,5-naphthalene diisocyanate, hexamethylene diisocyanate, isophorone diisocyanate, p-phenylene diisocyanate, transcyclohexane-1,4-diisocyanate, xylene diisocyanate(XDI), hydrogenated xylene diisocyanate, hydrogenated methylene diphenyl diisocyanate, lysine diisocyanate, triphenylmethane triisocyanate, tris(isocyanatophenyl) thiophosphate, tetramethylxylene diisocyanate, lysine ester triisocyanate, 1,6,11-undecane triisocyanate, 1,8-diisocyanate-4-isocynate methyloctane, 1,3,6-hexamethylene triisocyanate, bicycloheptane triisocyanate, trimethylhexamethylene diisocyanate and the like, or block isocyanate having a structure of masking isocyanate with blocking agent. The block isocyanate may not react at an ambient temperature, but if heated up to the temperature that the block agent is dissociated, may result in isocyanate groups being regenerated. The above-listed components may be used individually, or two or more may be used in combination.

Examples of polyol component may include, but are not limited to, polyoxypropylene glycol, polytetramethylene ether glycol, tetrahydrofuran (THF)-alkylene oxide copolymer polyol, polyester polyol, acryl polyol, polyolefin polyol, partially hydrolyzed ethylene vinyl acetate copolymer, phosphate type polyol, halogen-containing polyol, adipate type polyol, polycarbonate type polyol, polycaprolactone type polyol, polybutadiene polyol and the like. The above-listed components may be used individually, or two or more thereof may be used in combination.

Catalyst may be added selectively when using urethane resin, in which examples of catalyst may include, but are not limited to, triethylamine, N,N, N',N'-tetramethylethylenediamine, N,N,N',N",N"-pentamethyldiethylenetriamine, triethylenediamine, dimethylaminoethanol, bis(2-methylaminoethyl)ether and the like. Relative to 100% by weight of the total of the polyol components and the isocyanate components, the amount of catalyst may range from about 0.05% to about 5% by weight.

If urethane resin is used, other type of resins or functional additives may be adequately added without compromising the function of the urethane resin. Examples of resins addable along with the urethane resin may include, but are not limited to, styrene resin, acrylic resin, vinyl-chloride resin, styrene-vinyl acetate copolymer, rosin modified maleic acid resin, phenol resin, epoxy resin, polyester resin, fluorocarbon resin, low molecular weight polyethylene, low molecular weight polypropylene, ionomer resin, polyurethane resin, nylon resin, silicone resin, ketone resin, ethylene-ethyl acrylate copolymer, xylene resin, polyvinyl butyral (PVB) resin and the like.

The conductive resin layer 533 of the developing roller 530 may contain a metal oxide as a filler, and particularly may contain a surface-treated metal oxide. The metal oxide may provide suitable strength of the conductive resin layer 533, adjust the surface roughness, and may influence the amount of charge in the toner.

A silane compound may be used to surface-treat the metal oxide. Examples of silane compound that can be used may include, but are not limited to, vinyltrichlorosilane, vinyltrimethoxy-silane, vinyltriethoxysilane, 2-(3,4 epoxycyclohexyl)ethyltrimethoxysilane, 3-glycidoxypropyl-trimethoxysilane, 3-glycidoxypropylmethyldiethoxysilane, 3-glycidoxypropyltriethoxysilane, p-styryltrimethoxysilane, 3-methacryloxypropylmethyldimethoxysilane, 3-methacryloxypropyl-trimethoxysilane, 3-methacryloxypropylmethyldiethoxysilane, 3-methacryl-oxypropyl-triethoxysilane, 3-acryloxypropyltrimethoxysilane, N-(2-aminoethyl)-3-aminopropyl-methyl-dimethoxysilane, N-2(aminoethyl)-3-aminopropyltriethoxysilane, 3-aminopropyl-trimethoxy-silane, 3-aminopropyltriethoxysilane, 3-triethmsilyl-N-(1,3-dimethyl-butylidene)-propylamine, N-phenyl-3-aminopropyltrimethoxysilane, N-(vinylbenzyl)-2-aminoethyl-3-aminopropyl-trimethoxysilane hydrochloride, 3-chloropropyltrimethoxysilane, 3-mercaptopropylmethyl-dimethoxysilane, 3-mercaptopropyltrimethoxysilane, bis(triethoxysilylpropyl)tetrasulfide, tetraethoxysilane, methyltrimethoxysilane, methyltriethoxysilane, dimethyldimethoxysilane, phenyltrimethoxysilane, hexamethyldisilazane, hexyltrimethoxysilane, hexyltriethoxysilane, decyltrimethoxysilane, methylhydrogen siloxane and the like. The above-listed compounds may be used individually, or two or more may be used in combination.

The amount of the silane compound for the surface-treatment of the metal oxide may range from about 1% to about 40% by weight, relative to 100% by weight of the metal oxide. Less than 1% by weight of the silane compound may not provide desirable surface-treatment effect, whereas more than 40% by weight of the silane compound may cause increase the manufacturing costs, and may result in a decrease in productivity.

Examples of metal oxide may include, but are not limited to, titanium dioxide, silica, alumina, magnesium oxide, zinc oxide and the like. The amount of the surface-treated metal oxide may range from about 5% by weight to about 150% by weight, relative to 100% by weight of the resin, and more desirably, may range from about 10% by weight to about 120% by weight. The use of the surface-treated metal oxide in less than 5% by weight may not have sufficient influence in the charging characteristic of the conductive resin layer, whereas the use of the surface-treated metal oxide in more than 150% by weight may make the regulation of the electrical characteristic difficult.

Fillers other than the surface-treated metal oxide may selectively added in the conductive resin layer 533 of the developing roller 530. For instance, Examples of fillers for adjusting the surface roughness may include, but are not limited to, acrylic resin such as polyacrylate or polymethacrylate, polyamide resin such as nylon, polyolefin resin such as polyethylene or polypropylene, silicone resin, phenol resin, polyurethane resin, styrene resin, benzoguanamine, polyfluorovinyllidene resin, boron nitride, silicone carbide and the like. The filler may not necessarily have a specific shape, and accordingly, may have globular shape, platen shape, or atypical shape, as necessary. If macromolecular resin is used as the filler, a cross-linked macromolecular resin may be used. It is possible to adjust the surface roughness by adjusting the grain size or content of the particles of the filler, and/or by adjusting the thickness of the coated layer.

The conductive resin layer 533 of the developing roller 530 may further contain a stabilizer, an example of which may include, but is not limited to, an amine stabilizer having a primary, secondary, or tertiary amine structure.

The stabilizer may have any of the following chemical formulae:

Chemical Formula 1:

(1)

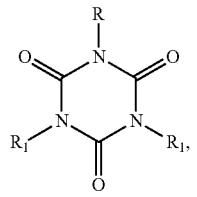

wherein $R_1$ is

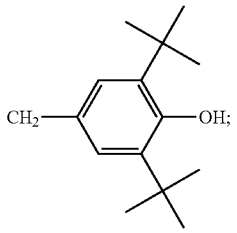

Chemical Formula 2:
(2)
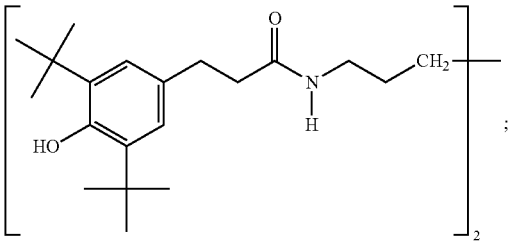
Chemical Formula 3:
(3)
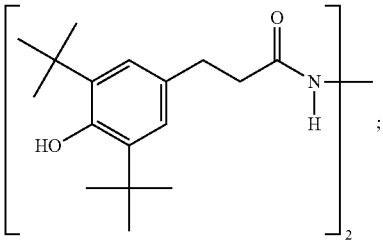
Chemical Formula 4:
(4)
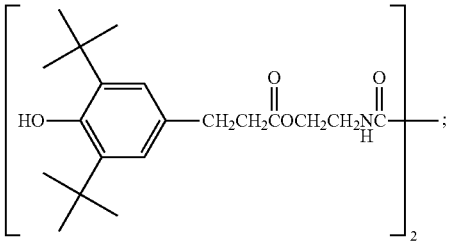
Chemical Formula 5:
(5)
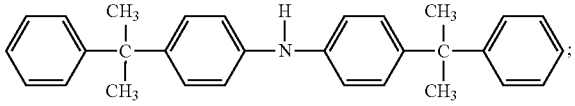
Chemical Formula 6:
(6)
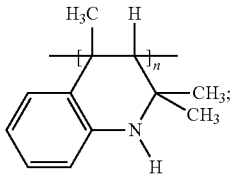
Chemical Formula 7:
(7)
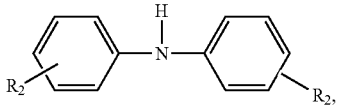
wherein $R_2$ may be a fatty or aromatic hydrocarbon;
Chemical Formula 8:
(8)
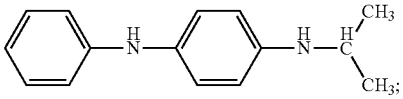
Chemical Formula 9:
(9)
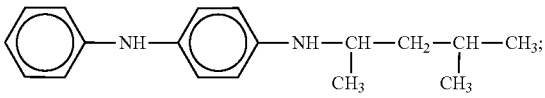
Chemical Formula 10:
(10)
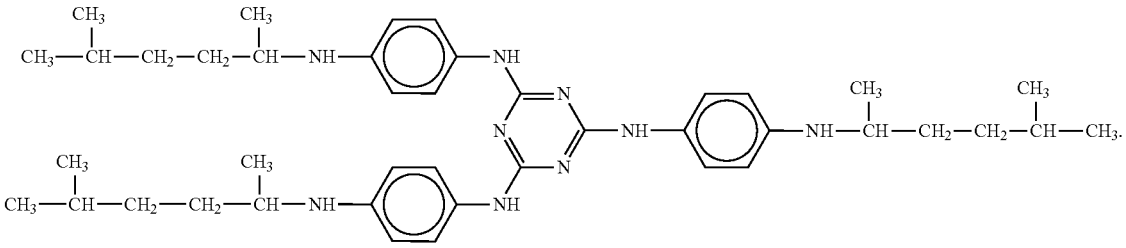

The amount of the stabilizer may range from about 0.1% by weight to about 10% by weight, relative to 100% by weight of the resin.

If urethane resin is used as the resin for the conductive resin layer 533, an amine stabilizer may be used, since the amine stabilizer may prevent aging of the urethane during the urethane solidification reaction or during the oxide layer formation involving a UV irradiation on the conductive resin layer.

A general disperser such as, for example, paint shaker, sand mill, roll mill, dino mill, or ball mill may be used to make the coating material for forming the conductive resin layer 533. By using a disperser, it may be possible to add, mix and stir the resin, surface-treated metal oxide and the other additives.

A solidifier or solidification accelerator may be added before, during or after stirring.

In order to remove any remaining monomer on the conductive resin layer, and to provide suitable change surface characteristic of the conductive resin layer, post-processing such as UV or excimer processing may be performed.

The conductive resin layer 533 may have a thickness ranging from about 1 μm to about 100 μm, or from about 3 μm to about 50 μm.

Additionally, the conductive resin layer may have resistivity adjusted to range from about $10^3$ to about $10^8$ Ωcm, or from about $10^4$ to about $10^7$ Ωcm.

The developing roller 530 may have a surface roughness (Rz) adjusted to range from about 1 μm to about 20 μm, or from about 3 μm to about 15 μm.

The developing roller 530 according to one or more embodiments described herein may increase the amount of toner charging, and may provide a high level of optical density and durability, and thus can be used for a long time. Tests were conducted by comparing a developing roller 530 with comparative examples.

For further illustration of various aspects of the present disclosure, several specific examples will now be described. It should be understood however that these examples are for illustrative purposes only, and are not intended to limit the scope of the present disclosure.

EXAMPLES

Preparation of the Semiconductive Developing Roller

Nitrile butadiene rubber (55% by weight) and epichlorohydrin rubber (45% by weight) were added to a preheated Banbury Mixer, and are fused. The fused rubber was then moved to an open roller, in which carbon black (2.5% by weight) and sulfur (15% by weight) were added thereto. The resulting mixture was dispersed homogeneously, and left at ambient temperature for 24 hours. The homogeneous mixture was extruded on a tube with a single screw extruder at a temperature from about 80° C. to about 90° C., and vulcanized by applying 5 kgf/cm$^2$ of pressure at 150° C. The resulting vulcanized rubber tube was heated and adhered onto the outer circumference of a shaft formed from a stainless steel (SUS) shaft, which has 6π of outer diameter and 26 cm of length, using Camlock as an adhesive. The resulting semiconductive rubber roller was adjusted to have an outer diameter of 14π, and a surface roughness ranging from Rz 2 to Rz 11. As a result, a semiconductive developing roller was prepared.

Example 1

Spherical silica (Sunjin Chemical, 130NP) (100% by weight), silane compound N-(2-aminoethyl)-3-aminopropylmethyldimethoxysilane (ShinEtsu, KBM-602) (10% by weight), ethanol (250% by weight) were stirred with a stirrer for 48 hours, filtered, rinsed, and heated at 150° C. for 2 hours, thereby obtaining a surface-treated silica.

Polyester polyol (100% by weight), acrylic resin (5% by weight), conductive carbon black (8% by weight), the surface-treated silica prepared as described herein (70% by weight), the stabilizer represented by Formula 2 herein (2% by weight), and methylethylketone (500% by weight) were processed with a ball mill for 24 hours, and polyisocyanate (30% by weight) was then added to the mixture to yield a coating fluid for the conductive resin layer.

The coating fluid was dip coated on the conductive resilient layer of the semiconductive developing roller prepared as described herein, solidified by heating at 150° C., to form a conductive resin layer having a coating layer of 20 μm thickness.

Example 2

Spherical silica (Sunjin Chemical, 130NP) (100% by weight), silane compound 3-aminopropyltriethoxysilane (ShinEtsu, KBM-903) (10% by weight), and ethanol (250% by weight) were stirred with a stirrer for 48 hours, filtered, rinsed, and heated at 150° C. for 2 hours to obtain a surface-treated silica. The developing roller was then prepared in the same manner as described herein in Example 1, except the developing roller used the surface-treated silica prepared as described herein.

Example 3

The developing roller was prepared in the same manner as in Example 1, except 2% by weight of the stabilizer of Formula 5 herein was used.

Example 4

The developing roller was prepared in the same manner as in Example 1, except 2% by weight of the stabilizer of Formula 8 herein was used.

Comparative Example 1

Spherical silica (Sunjin Chemical, 130NP) (100% by weight), silane compound methyltrimethoxysilane (ShinEtsu, KBE-13) (10% by weight), ethanol (250% by weight) were stirred with a stirrer for 48 hours, filtered, rinsed, and heated at 150° C. for 2 hours, to thus yield a surface-treated silica. The developing roller was then prepared in the same manner as described in Example 1, except the developing roller used the surface-treated silica prepared as described herein.

Comparative Example 2

The developing roller was prepared in the same manner as described in Example 1, except non-surface treated silica (70% by weight) was used.

Comparative Example 3

The developing roller was prepared in the same manner as described in Example 1, except a stabilizer was not used.

Tests

1. Measurement of Surface Roughness

The surface roughness was measured using KEYENCE VK-9510.

2. Measurement of Amount of Toner Charging

The amount of toner charging was measured based on the amount of toner remaining on the developing roller after passing through the toner layer regulating device, using Q/M Meter.

3. Optical Density

The temporal changes in solid image density were compared using GretagMacbeth SpectroEye, on the basis of the initial optical density and optical density after printing on 6000 sheets of paper.

Test results are included in Table 1.

TABLE 1

| | Ex 1 | Ex 2 | Ex 3 | Ex 4 | Comp. Ex 1 | Comp. Ex 2 | Comp. Ex 3 |
|---|---|---|---|---|---|---|---|
| Surface Roughness Rz (μm) | 12 | 11 | 13 | 12 | 10 | 11 | 10 |
| Amount of toner charging Q/M (μC/g) | −27 | −24 | −26 | −25 | −15 | −17 | −26 |
| Optical density (Early period) | 1.4 | 1.4 | 1.3 | 1.4 | 1.3 | 1.2 | 1.4 |
| Optical density (after 6k) | 1.4 | 1.3 | 1.3 | 1.3 | 1.1 | 1.0 | 1.1 |

The developing rollers, prepared by coating the conductive resin layer having surface-treated silica (Examples 1 to 4, and Comparative Example 3), showed a large amount of toner charging, e.g., greater than 20 μC/g. The increased amount of toner charging improves uniformity of toner charging, which in turn may reduce the optical changes that may occur due to aging, and may also prevent ghosts or spread.

Depending on which silane compound is used for surface-treatment, the influence on the charging characteristics of the toner on the developing roller may be different. For example, a non-chargeable toner may have reduced non-chargeability if an alkylsilane surface-treated metal oxide is used, or increased non-chargeability if an aminosilane surface-treated metal oxide is used.

Comparative Example 3 showed a large amount of toner charging, but after 6000 sheets of printing, changed optical density from 1.4 to 1.1. The difference in the optical density may be understood to be caused by the absence of stabilizer.

While the present disclosure has been particularly shown and described with reference to several embodiments thereof, it will be understood by those of ordinary skill in the art that various changes in form and details may be made thereto without departing from the principles and spirit of the present disclosure, the proper scope of which is defined in the following claims and their equivalents.

What is claimed is:

1. A developing roller for an electrophotographic image forming apparatus, comprising:

a shaft member; and a resilient member provided on the shaft member, wherein the resilient member comprises a conductive resilient layer in contact with the shaft member and a conductive resin layer defining an outer surface layer of the resilient layer, and wherein the conductive resin layer comprises a resin and a surface-treated metal oxide, the surface-treated metal oxide being surface-treated with a silane compound.

2. The developing roller of claim 1, wherein the surface-treated metal oxide comprises one or a combination of two or more metal oxides selected from titanium dioxide, silica, alumina, magnesium oxide and zinc oxide.

3. The developing roller of claim 1, wherein the silane compound is one or a combination of two or more silane compounds selected from vinyltrichlorosilane, vinyltrimethoxysilane, vinyltriethoxysilane, 2-(3,4 epoxycyclohexyl)ethyltrimethoxy-silane, 3-glycidoxypropyl-trimethoxysilane, 3-glycidoxypropylmethyldiethoxysilane, 3-glycidoxypropyltriethoxy-silane, p-styryltrimethoxysilane, 3-methacryloxypropylmethyl-dimethoxysilane, 3-methacryloxypropyltrimethoxysilane, 3-methacryloxypropylmethyl-diethoxysilane, 3-methacryloxypropyltriethoxysilane, 3-acryloxypropyltrimethoxysilane, N-(2-amino-ethyl)-3-aminopropylmethyldimethoxysilane, N-2 (aminoethyl)-3-amino-propyltriethoxy-silane, 3-aminopropyltrimethoxysilane, 3-aminopropyltriethoxysilane, 3-triethoxysilyl-N-(1,3 dimethyl-butylidene)propylamine, N-phenyl-3-aminopropyl-trimethoxysilane, N-(vinylbenzyl)-2-aminoethyl-3-aminopropyltrimethoxysilane hydrochloride, 3-chloro-propyltrimethoxysilane, 3-mercaptopropylmethyldimethoxysilane, 3-mercaptopropyl-trimethoxysilane, bis(triethoxysilylpropyl)tetrasulfide, tetraethoxysilane, methyl-trimethoxysilane, methyltriethoxysilane, dimethyldimethoxysilane, phenyltrimethoxy-silane, hexamethyldisilazane, hexyltrimethoxysilane, hexyltriethoxysilane, decyl-trimethoxysilane and methylhydrogen siloxane.

4. The developing roller of claim 1, wherein the silane compound ranges from about 1% by weight to about 40% by weight relative to 100% by weight of the surface-treated metal oxide.

5. The developing roller of claim 1, wherein the resin is one or a combination of two or more resins selected from polyamide resin, urethane resin, urea resin, imide resin, melamine resin, fluororesin, phenol resin, alkyl resin, silicone resin, polyester resin and polyether resin.

6. The developing roller of claim 1, wherein the conductive resin layer further comprises a stabilizer.

7. The developing roller of claim 6, wherein the stabilizer comprises an amine stabilizer having primary, secondary and tertiary amine structures.

8. A developing roller for an electrophotographic image forming apparatus, comprising:

a shaft member; and a resilient member provided on the shaft member, wherein the resilient member comprises a conductive resilient layer in contact with the shaft member and a conductive resin layer defining an outer surface layer of the resilient layer, and wherein the conductive resin layer comprises a resin and a surface-treated metal oxide, the surface-treated metal oxide to range from about 5% by weight to about 150% by weight relative to 100% by weight of the resin.

* * * * *